US007690964B2

(12) United States Patent
Nuttall et al.

(10) Patent No.: US 7,690,964 B2
(45) Date of Patent: Apr. 6, 2010

(54) TOY RAMP DEVICES

(75) Inventors: Michael Nuttall, South Pasadena, CA (US); Harold Garner, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 314 days.

(21) Appl. No.: 11/744,665

(22) Filed: May 4, 2007

(65) Prior Publication Data

US 2008/0009219 A1 Jan. 10, 2008

Related U.S. Application Data

(60) Provisional application No. 60/798,140, filed on May 4, 2006, provisional application No. 60/797,952, filed on May 5, 2006, provisional application No. 60/812,315, filed on Jun. 8, 2006.

(51) Int. Cl.
*A63H 18/00* (2006.01)
*A63H 29/08* (2006.01)

(52) U.S. Cl. ..... 446/444; 446/168

(58) Field of Classification Search ..... 446/444–447, 446/429, 168, 170, 173, 174, 430; 104/54, 104/79

See application file for complete search history.

(56) References Cited

U.S. PATENT DOCUMENTS

| | | | |
|---|---|---|---|
| 738,586 | A | 9/1903 | Wilson |
| 740,765 | A | 10/1903 | Koster |
| 749,607 | A | 1/1904 | Dutrieu |
| 1,431,398 | A | 10/1922 | Hetzner |
| 1,493,649 | A | 5/1924 | Schulz |
| 1,523,244 | A | 1/1925 | Bain |
| 1,603,180 | A | 10/1926 | Zabel |
| 1,662,162 | A | 3/1928 | Nestor |
| 1,695,310 | A | 12/1928 | Wustendorfer |
| 1,715,891 | A | 6/1929 | Beck |
| 1,914,116 | A | 6/1933 | Ford |
| 1,965,676 | A | 7/1934 | Stock |
| 2,168,010 | A | 8/1939 | Verplanck |
| 2,171,634 | A | 9/1939 | Rexford et al. |
| 2,198,306 | A | 4/1940 | Fisher |

(Continued)

FOREIGN PATENT DOCUMENTS

| | | |
|---|---|---|
| DE | 3106081 | 8/1982 |

(Continued)

*Primary Examiner*—Gene Kim
*Assistant Examiner*—Alyssa M Hylinski
(74) *Attorney, Agent, or Firm*—Kolisch Hartwell, P.C.

(57) ABSTRACT

A toy ramp device for two or more moveable objects is disclosed. In some embodiments, the toy ramp device may include a base; a ramp configured to support at least a first of the two or more moveable objects and including a first ramp end portion and a second ramp end portion, the ramp being movably connected to the base and configured to move among a plurality of positions relative to the base; and a holder mechanism attached to the ramp and configured to support at least one of the two or more moveable objects adjacent to the ramp when the ramp is in the first position, and to allow the at least one of the two or more moveable objects to move onto the ramp and move along the ramp toward the second ramp end portion when the ramp is in the second position.

21 Claims, 4 Drawing Sheets

U.S. PATENT DOCUMENTS

| | | | | | |
|---|---|---|---|---|---|
| 2,211,220 | A | | 8/1940 | Verplanck | |
| 2,214,310 | A | | 9/1940 | Schreffler | |
| 2,239,395 | A | | 4/1941 | Mallory | |
| 2,401,468 | A | | 6/1946 | Duffy | |
| 2,616,630 | A | | 11/1952 | Michele | |
| 2,618,437 | A | | 11/1952 | Matthaeis, Jr. | |
| 2,726,869 | A | | 12/1955 | Schulte | |
| 2,815,872 | A | | 12/1957 | Graham | |
| 2,853,301 | A | | 9/1958 | Glass | |
| 2,998,196 | A | | 8/1961 | Eenigenburg, Jr. | |
| 3,074,200 | A | | 1/1963 | Ziegenfuss | |
| D197,616 | S | | 3/1964 | Dunbar | |
| 3,126,670 | A | | 3/1964 | Smith | |
| 3,204,574 | A | | 9/1965 | Frisbie et al. | |
| 3,209,491 | A | | 10/1965 | Roeper | |
| D204,468 | S | | 4/1966 | Smedley et al. | |
| 3,289,830 | A | | 12/1966 | Foote | |
| 3,299,565 | A | | 1/1967 | Yarashes | |
| 3,315,632 | A | | 4/1967 | Hyden | |
| 3,359,920 | A | * | 12/1967 | Iammatteo | 463/62 |
| 3,376,844 | A | | 4/1968 | Wood | |
| 3,502,332 | A | | 3/1970 | Wolf | |
| 3,509,662 | A | * | 5/1970 | Lunzer | 446/216 |
| 3,542,366 | A | | 11/1970 | Schocker | |
| 3,589,063 | A | | 6/1971 | Genin | |
| 3,618,947 | A | | 11/1971 | Cooper et al. | |
| 3,621,602 | A | | 11/1971 | Barcus et al. | |
| 3,641,704 | A | | 2/1972 | Sims et al. | |
| 3,648,454 | A | | 3/1972 | Morrison | |
| 3,658,333 | A | | 4/1972 | Carcel | |
| 3,665,636 | A | | 5/1972 | Benson et al. | |
| 3,674,269 | A | | 7/1972 | Cooper et al. | |
| 3,690,393 | A | | 9/1972 | Guy | |
| 3,708,116 | A | | 1/1973 | Woodward | |
| 3,712,615 | A | | 1/1973 | Staats et al. | |
| 3,735,923 | A | | 5/1973 | Brigham et al. | |
| 3,777,394 | A | | 12/1973 | Staats et al. | |
| 3,797,164 | A | | 3/1974 | Glass et al. | |
| 3,814,021 | A | | 6/1974 | McHenry | |
| 3,827,693 | A | | 8/1974 | Barlow et al. | |
| 3,841,223 | A | | 10/1974 | Bertin | |
| D233,620 | S | | 11/1974 | Seki | |
| 3,858,875 | A | | 1/1975 | Nemeth et al. | |
| 3,860,237 | A | | 1/1975 | Cooper et al. | |
| 3,939,979 | A | | 2/1976 | Neumayer | |
| 3,970,309 | A | | 7/1976 | Sato | |
| 3,984,105 | A | | 10/1976 | Breslow | |
| 4,068,402 | A | | 1/1978 | Tanaka | |
| 4,077,628 | A | | 3/1978 | Hebert | |
| 4,087,935 | A | | 5/1978 | Edmisson et al. | |
| 4,094,089 | A | * | 6/1978 | Sano | 446/487 |
| 4,108,437 | A | | 8/1978 | DeAnda et al. | |
| 4,129,916 | A | | 12/1978 | Schlesinger et al. | |
| 4,146,991 | A | | 4/1979 | Sano | |
| 4,161,279 | A | | 7/1979 | Halford | |
| 4,185,409 | A | * | 1/1980 | Cheng | 446/487 |
| 4,202,464 | A | | 5/1980 | Mohs et al. | |
| 4,221,076 | A | | 9/1980 | Ozawa | |
| 4,249,733 | A | * | 2/1981 | Eddins et al. | 463/69 |
| 4,254,576 | A | | 3/1981 | Matsumoto et al. | |
| 4,319,425 | A | | 3/1982 | Shine | |
| 4,349,983 | A | | 9/1982 | Kilroy et al. | |
| 4,355,807 | A | * | 10/1982 | Prehodka | 463/63 |
| 4,383,688 | A | | 5/1983 | Prehodka | |
| 4,408,413 | A | | 10/1983 | Hyland et al. | |
| 4,423,871 | A | | 1/1984 | Mucaro | |
| 4,468,031 | A | | 8/1984 | Barlow et al. | |
| 4,475,881 | A | | 10/1984 | Borst et al. | |
| 4,493,265 | A | | 1/1985 | Miura | |
| 4,496,100 | A | | 1/1985 | Schwager et al. | |
| 4,513,966 | A | | 4/1985 | Mucaro et al. | |
| 4,513,967 | A | | 4/1985 | Halford et al. | |
| 4,519,789 | A | | 5/1985 | Halford et al. | |
| 4,536,168 | A | | 8/1985 | Stephens | |
| 4,558,867 | A | | 12/1985 | Hippely | |
| 4,564,197 | A | | 1/1986 | Lambert et al. | |
| RE32,106 | E | | 4/1986 | Lemelson | |
| 4,605,229 | A | | 8/1986 | McKay | |
| 4,605,230 | A | | 8/1986 | Halford et al. | |
| 4,618,119 | A | | 10/1986 | Powell | |
| 4,661,080 | A | | 4/1987 | Goldstein et al. | |
| 4,697,812 | A | | 10/1987 | Rudell et al. | |
| 4,710,149 | A | | 12/1987 | Prusman | |
| 4,715,602 | A | | 12/1987 | May et al. | |
| 4,715,843 | A | | 12/1987 | Ostendorff et al. | |
| 4,726,516 | A | | 2/1988 | Cree | |
| 4,767,053 | A | | 8/1988 | Cook et al. | |
| 4,848,243 | A | | 7/1989 | Giordano | |
| 4,872,680 | A | | 10/1989 | Dennis | |
| D305,676 | S | | 1/1990 | Ngai | |
| 4,905,828 | A | | 3/1990 | Dods | |
| 4,912,796 | A | | 4/1990 | Crump | |
| 4,925,188 | A | | 5/1990 | McKay et al. | |
| 4,937,207 | A | | 6/1990 | Simmell et al. | |
| 4,979,926 | A | | 12/1990 | Bisceglia | |
| 5,035,393 | A | | 7/1991 | Menaged | |
| 5,038,685 | A | | 8/1991 | Yoneda et al. | |
| 5,052,972 | A | | 10/1991 | Suimon et al. | |
| 5,174,569 | A | * | 12/1992 | Ngai | 463/63 |
| 5,234,216 | A | | 8/1993 | Ostendorff | |
| 5,237,763 | A | | 8/1993 | Ochoa | |
| 5,254,030 | A | | 10/1993 | Ostendorff et al. | |
| D344,104 | S | | 2/1994 | Yen | |
| 5,312,285 | A | * | 5/1994 | Rieber et al. | 446/168 |
| 5,370,223 | A | | 12/1994 | Leicht, Jr. | |
| D358,271 | S | | 5/1995 | Leveen et al. | |
| D358,611 | S | | 5/1995 | Dainoff et al. | |
| 5,440,996 | A | | 8/1995 | Cottino | |
| 5,452,893 | A | | 9/1995 | Faulk et al. | |
| 5,542,668 | A | * | 8/1996 | Casale et al. | 463/59 |
| 5,560,500 | A | | 10/1996 | Wilcox | |
| 5,586,923 | A | | 12/1996 | Hippely et al. | |
| 5,601,490 | A | | 2/1997 | Nakagawa et al. | |
| 5,611,432 | A | | 3/1997 | Dods | |
| 5,651,525 | A | | 7/1997 | Yang | |
| 5,651,736 | A | | 7/1997 | Myers | |
| 5,657,695 | A | | 8/1997 | Lanoix et al. | |
| 5,676,586 | A | | 10/1997 | James | |
| 5,678,489 | A | | 10/1997 | Wang | |
| 5,758,777 | A | | 6/1998 | Dods | |
| 5,767,655 | A | | 6/1998 | Ostendorff et al. | |
| 5,813,351 | A | | 9/1998 | Chen | |
| D404,931 | S | | 2/1999 | Duggan | |
| 5,865,661 | A | | 2/1999 | Cyrus et al. | |
| 5,890,945 | A | | 4/1999 | Asami et al. | |
| 5,899,789 | A | | 5/1999 | Rehkemper et al. | |
| 6,000,992 | A | * | 12/1999 | Lambert | 446/430 |
| 6,042,480 | A | | 3/2000 | Labelson | |
| 6,062,942 | A | | 5/2000 | Ogihara | |
| 6,074,269 | A | | 6/2000 | Rothbarth et al. | |
| 6,089,951 | A | | 7/2000 | Ostendorff | |
| 6,109,186 | A | | 8/2000 | Smith et al. | |
| 6,132,287 | A | | 10/2000 | Kuralt et al. | |
| 6,152,298 | A | | 11/2000 | Dods | |
| 6,152,417 | A | | 11/2000 | Randall | |
| 6,170,754 | B1 | | 1/2001 | Halford | |
| 6,176,760 | B1 | | 1/2001 | Ngai | |
| 6,193,581 | B1 | | 2/2001 | Wiggs et al. | |
| 6,216,600 | B1 | | 4/2001 | Verret | |
| 6,241,573 | B1 | | 6/2001 | Ostendorff et al. | |
| 6,358,112 | B1 | * | 3/2002 | Lambert et al. | 446/429 |
| 6,386,538 | B1 | | 5/2002 | Mejia | |
| 6,435,929 | B1 | | 8/2002 | Halford | |
| 6,439,955 | B1 | | 8/2002 | Feketo | |

| | | | | |
|---|---|---|---|---|
| 6,478,654 | B1 | 11/2002 | Rehkemper et al. | |
| 6,508,179 | B2 | 1/2003 | Annis et al. | |
| 6,517,007 | B2 | 2/2003 | Kong | |
| 6,572,434 | B2 | 6/2003 | Man | |
| 6,601,774 | B1 | 8/2003 | Kasimoff | |
| 6,647,893 | B1 | 11/2003 | Fugitt et al. | |
| 6,676,480 | B2 | 1/2004 | Sheltman | |
| 6,692,329 | B2 | 2/2004 | Peters | |
| 6,695,668 | B2 | 2/2004 | Donahue et al. | |
| 6,733,361 | B1 | 5/2004 | Rudell | |
| 6,736,330 | B2 * | 5/2004 | Kanda | 238/10 R |
| 6,776,685 | B2 | 8/2004 | Reisher et al. | |
| 6,783,417 | B2 | 8/2004 | Morrissy et al. | |
| 6,783,419 | B1 * | 8/2004 | Paukert et al. | 446/75 |
| 6,830,498 | B2 | 12/2004 | Elling | |
| 6,883,720 | B2 | 4/2005 | D'Angelo, Jr. et al. | |
| 6,908,396 | B1 | 6/2005 | Billig | |
| 6,913,508 | B2 | 7/2005 | Hornsby et al. | |
| 6,921,339 | B1 | 7/2005 | Martin et al. | |
| 6,935,574 | B2 | 8/2005 | Cheng | |
| 6,951,307 | B2 | 10/2005 | Lin | |
| 6,951,497 | B1 | 10/2005 | Ngan | |
| 6,951,498 | B2 | 10/2005 | Rudell | |
| 6,993,801 | B2 | 2/2006 | Marko et al. | |
| 7,025,656 | B2 | 4/2006 | Bailey | |
| 7,025,677 | B2 | 4/2006 | Kawase | |
| D542,876 | S | 5/2007 | Laurienzo et al. | |
| 7,225,492 | B2 | 6/2007 | Pratt | |
| 7,233,488 | B2 | 6/2007 | Liou et al. | |
| 7,261,614 | B2 | 8/2007 | Laurienzo et al. | |
| 7,467,436 | B1 | 12/2008 | Jones | |
| 2002/0195502 | A1 | 12/2002 | Delage | |
| 2003/0140433 | A1 | 7/2003 | Rieber | |
| 2003/0216102 | A1 | 11/2003 | Reisher et al. | |
| 2003/0224697 | A1 | 12/2003 | Sheltman et al. | |
| 2004/0238655 | A1 | 12/2004 | Monk | |
| 2005/0191938 | A1 | 9/2005 | Sheltman et al. | |
| 2005/0191940 | A1 | 9/2005 | Sheltman et al. | |
| 2005/0287919 | A1 | 12/2005 | Sheltman et al. | |
| 2006/0145046 | A1 | 7/2006 | Liou et al. | |
| 2006/0150347 | A1 | 7/2006 | Pratt | |
| 2006/0186303 | A1 | 8/2006 | Phifer et al. | |
| 2006/0286891 | A1 | 12/2006 | Knight et al. | |
| 2007/0049160 | A1 | 3/2007 | Matthes et al. | |
| 2007/0259600 | A1 | 11/2007 | Bedford et al. | |
| 2007/0293122 | A1 | 12/2007 | O'Connor et al. | |
| 2008/0051001 | A1 | 2/2008 | Nuttall et al. | |
| 2008/0265600 | A1 | 10/2008 | Barker | |
| 2008/0267729 | A1 | 10/2008 | Barker | |

FOREIGN PATENT DOCUMENTS

| | | |
|---|---|---|
| FR | 2555459 | 11/1983 |
| NL | 1008636 | 3/1998 |
| WO | 9201497 | 2/1992 |
| WO | 2007131205 | 11/2007 |
| WO | 2007131207 | 11/2007 |

* cited by examiner

Fig. 7
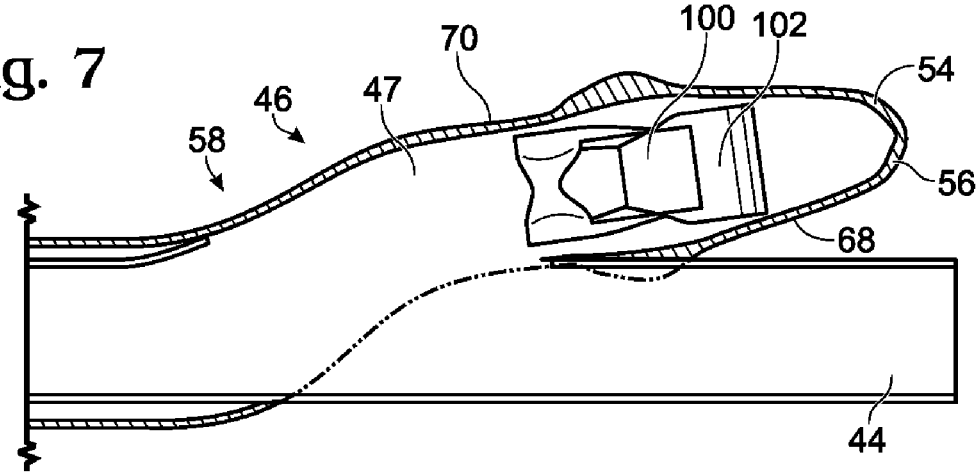
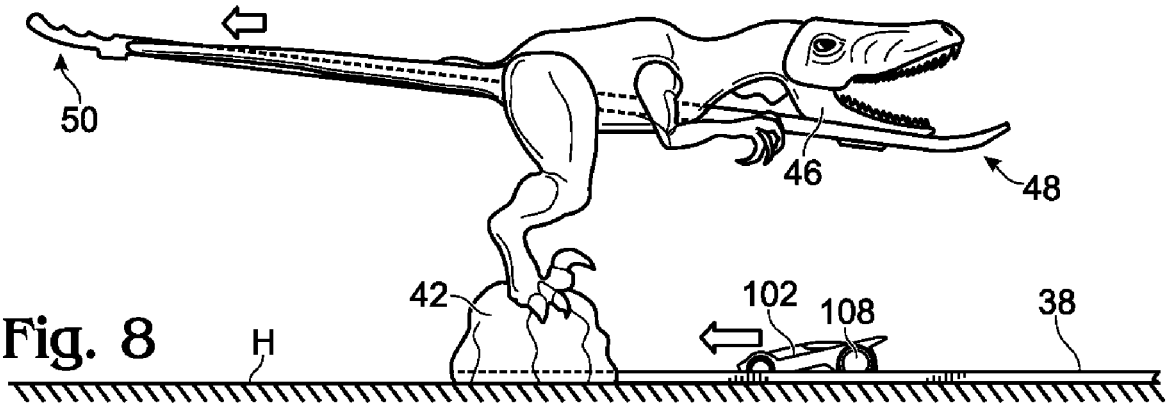
Fig. 8
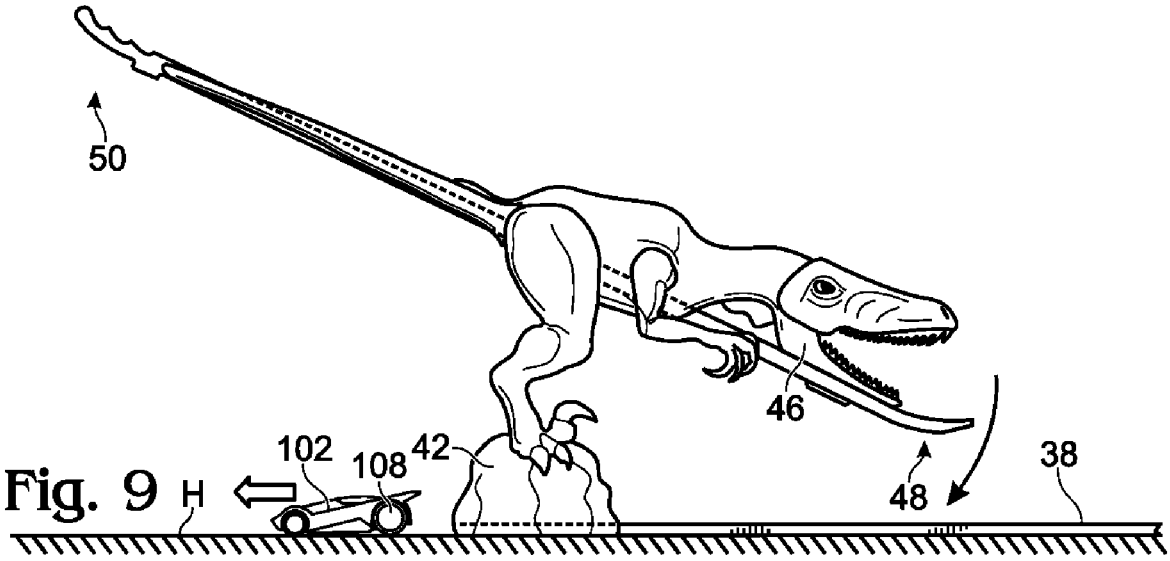
Fig. 9

TOY RAMP DEVICES

CROSS-REFERENCE TO RELATED APPLICATIONS

This application claims priority under 35 U.S.C. § 119(e) to U.S. Provisional Patent Application No. 60/798,140 entitled "Track with Moveable Obstacle," filed May 4, 2006, U.S. Provisional Patent Application No. 60/797,952 entitled "Track with Moveable Obstacle," filed on May 5, 2006, and U.S. Provisional Patent Application No. 60/812,315 entitled "Track with Moveable Obstacle," filed Jun. 8, 2006. The complete disclosures of the above applications are herein incorporated by reference for all purposes.

BACKGROUND OF THE DISCLOSURE

The present disclosure is directed to toy ramp devices for two or more moveable objects, including toy ramp devices that may be used with one or more toy track assemblies.

Examples of toy ramp devices and/or toy track assemblies are found in U.S. Pat. Nos. 740,765; 749,607; 1,431,398; 1,523,244; 1,603,180; 1,715,891; 1,965,676; 2,815,872; 3,204,574; 3,209,491; 3,858,875; 4,068,402; 4,094,089; 4,185,409; 4,355,807; 4,423,871; 4,493,265; 4,496,100; 4,513,967; 4,519,789; 4,661,080; 4,715,843; 4,767,053; 5,038,685; 5,174,569; 6,074,269; 6,132,287; 6,176,760; 6,216,600; 6,241,573; 6,358,112; 6,435,929; 6,439,955; 6,517,007; 6,572,434; 6,692,329; 6,695,668; 6,733,361; 6,736,330; 6,783,419; 6,830,498; 6,883,720; 6,908,396; 6,913,508; 6,935,574; 6,951,307; 6,951,498; and 7,025,656. The complete disclosures of the above patents are herein incorporated by reference for all purposes.

SUMMARY OF THE DISCLOSURE

Some embodiments provide a toy ramp device for two or more moveable objects. In some embodiments, the toy ramp device may include a base configured to be supported on a horizontal surface; a ramp configured to support at least a first of the two or more moveable objects and including a first ramp end portion and a second ramp end portion, the ramp being movably connected to the base and configured to move among a plurality of positions relative to the base, including a first position in which the first ramp end portion contacts the horizontal surface, and a second position in which the first ramp end portion is spaced from the horizontal surface; and a holder mechanism attached to the ramp and configured to support at least one of the two or more moveable objects adjacent to the ramp when the ramp is in the first position, and to allow the at least one of the two or more moveable objects move onto the ramp and move along the ramp toward the second ramp end portion when the ramp is in the second position.

In some embodiments, the toy ramp device may include a base; a track attached to the base and configured to support at least a first of the two or more moveable objects; a ramp configured to support the at least a first of the two or more moveable objects and including a first ramp end portion and a second ramp end portion, the ramp being movably connected to the base and configured to move among a plurality of positions, including a first position in which the first ramp end portion is aligned with a portion of the track, and a second position in which the first ramp end portion is spaced from the portion of the track relative to the first position, wherein the ramp is configured to move from the first position toward the second position when the at least a first of the two or more moveable objects moves along the ramp from the first ramp end portion toward the second ramp end portion; and a holder mechanism attached to the ramp and configured to support at least one of the two or more moveable objects adjacent to the ramp when the ramp is in the first position, and to allow the at least one of the two or more moveable objects to move onto the ramp and move along the ramp toward the second ramp end portion when the ramp is in the second position.

Some embodiments provide a toy ramp device. In some embodiments, the toy ramp device may include two or more toy vehicles; a base; a track including a first track end portion attached to the base and a second track end portion spaced from the base; a launch assembly attached to the second track end portion and configured to selectively propel at least a first of the two or more toy vehicles toward the first track end portion; a ramp configured to support the at least a first of the two or more toy vehicles and including a first ramp end portion and a second ramp end portion, the ramp being pivotally connected to the base and configured to pivot among a plurality of positions, including a first position in which the ramp slopes upwardly from the first ramp end portion toward the second ramp end portion, and a second position in which the ramp slopes downwardly from the first ramp end portion toward the second ramp end portion, wherein the ramp is configured to move from the first position toward the second position when the at least a first of the two or more toy vehicles moves along the ramp from the first ramp end portion toward the second ramp end portion; and a holder mechanism connected to the ramp and configured to support at least one of the two or more toy vehicles adjacent to the ramp when the ramp is in the first position, and to allow the at least one of the two or more toy vehicles to move onto the ramp and move along the ramp toward the second ramp end portion when the ramp is in the second position.

BRIEF DESCRIPTION OF THE DRAWINGS

FIG. 7 is a cross-sectional view of the ramp assembly of FIG. 3 taken along lines 7-7 in FIG. 3 showing a holder mechanism of the ramp assembly.

FIGS. 8-9 are partial side views of the toy ramp device of FIG. 1 showing the ramp of the ramp assembly of FIG. 3 in intermediate positions with a toy car moving along a track through a base of the ramp assembly and onto a horizontal surface.

DETAILED DESCRIPTION OF THE DISCLOSURE

Figure 1:
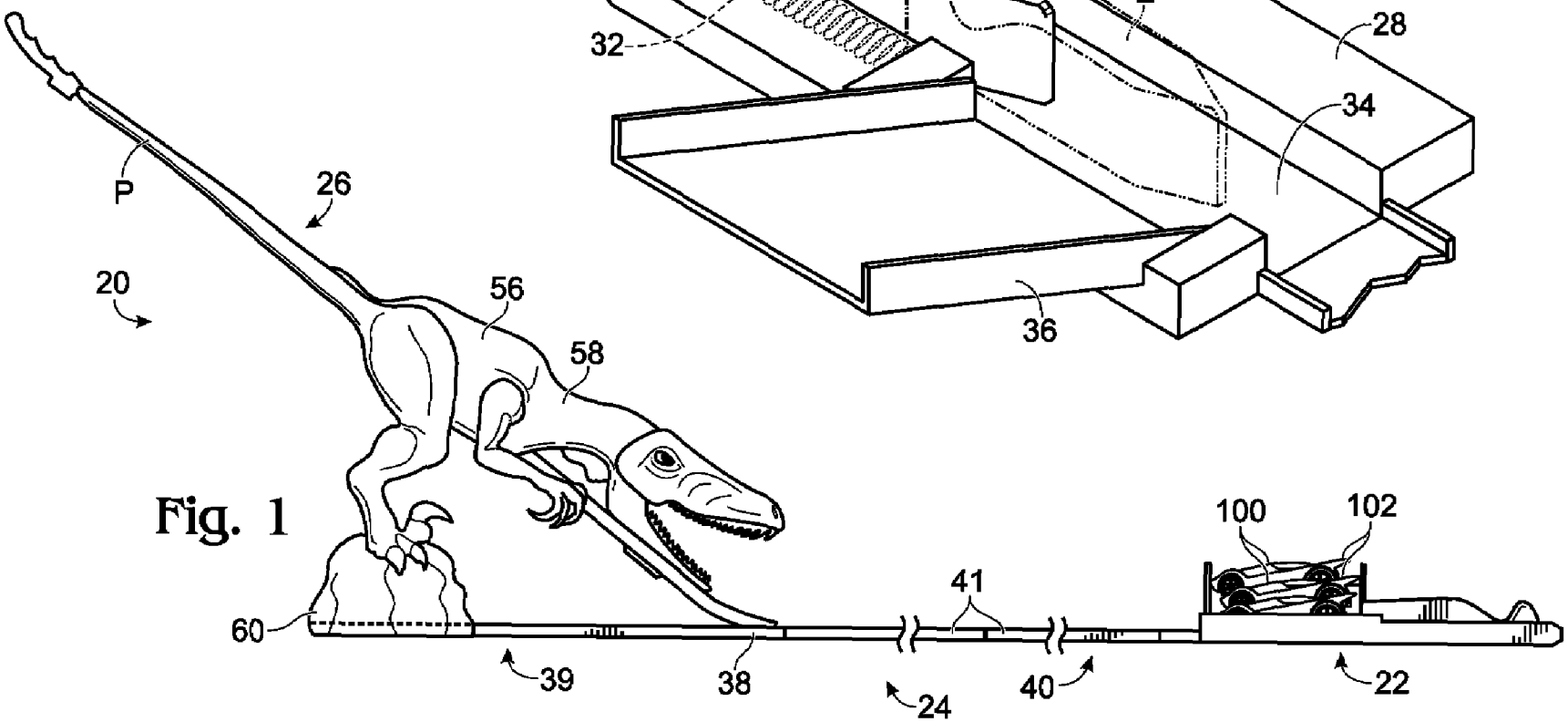
FIG. 1 is a side view of an example of a toy ramp device.

FIG. 1 shows an example of a toy ramp device 20 for two or more moveable objects 100. The moveable objects may include any suitable structure configured to move on and/or be supported by one or more portions of the toy ramp device. For example, the moveable objects may include two or more toy vehicles 102.

The toy vehicles may be self-propelled and/or may need one or more external forces, such as forces from a person, gravity, and/or a launch assembly, to move the toy vehicles. The toy vehicles may have four wheels and include a body and/or frame that resembles one or more sports cars. Although toy vehicles with a particular structure and aesthetic features are shown, the toy vehicles may include any suitable structure and/or may have any suitable aesthetic features. For example, the toy vehicles may have any suitable number of wheels, such as three wheels, two wheels, or one wheel.

Additionally, or alternatively, the toy vehicles may have a body and/or frame with aesthetic features that resemble a sport-utility vehicle, a race vehicle, a luxury vehicle, a motorcycle, an all-terrain vehicle, a cycle with one or more wheels (such as a unicycle, bicycle, or tricycle), etc. Alternatively, or additionally, moveable objects 100 may include other type(s) of objects. For example, the moveable objects may include balls (such as marbles) and/or mobile toy figures (such as toy figures with wheels or toy figures on skateboards, roller-blades, or roller-skates).

Figure 2:
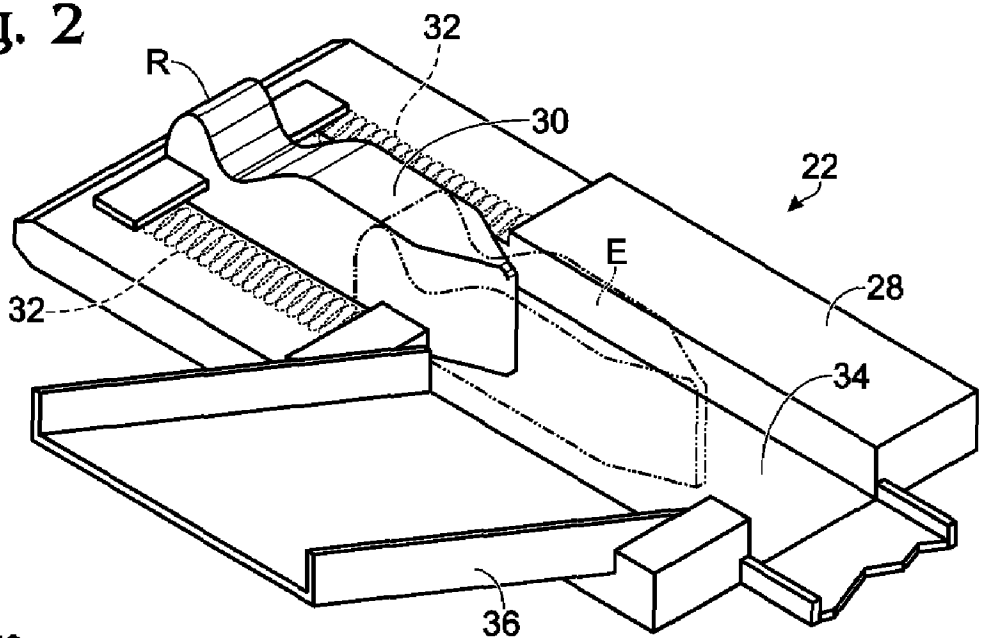
FIG. 2 is a partial isometric view of the toy ramp device of FIG. 1 showing an example of a launch assembly.

The toy ramp device may include a launch assembly 22, a track assembly 24, and a ramp assembly 26, as shown in FIG. 1. The launch assembly may include any suitable structure configured to selectively propel one or more of the moveable objects towards any suitable launch objective(s), such as an end portion of a track of the track assembly and/or an end portion of a ramp of the ramp assembly. For example, launch assembly 22 may include a holder 28, a plunger 30, and one or more bias elements 32, as shown in FIG. 2.

The holder may be sized to support one or more of the moveable objects and may include a holder track 34, which may align and/or connect with a track of the track assembly and/or a ramp of the ramp assembly. Plunger 30 may be movably connected to the holder and may be configured to selectively move among a plurality of positions relative to the holder. For example, the plunger may be slidingly connected to the holder and may move between a retracted position R in which at least one of the moveable objects may be supported on the holder track of the holder, and an extended position E in which the holder is in a rest state. During movement of the plunger from the retracted position to the extended position under the influence of bias elements 32, the at least one of the movable objects supported on holder track 34 may be propelled away from the holder.

Bias elements 32 may urge the plunger toward one or more of the plurality of plunger positions. For example, bias elements 32 may urge the plunger toward the extended position. The bias elements may include any suitable structure, including coil spring(s), leaf spring(s), musical wire(s), etc. Although two bias elements 32 are shown in FIG. 2, the launch assembly may include any suitable number of bias elements. In some embodiments, launch assembly 22 also may include a loader 36 (such as an incline) that may position one or more of the moveable objects onto the holder adjacent the plunger for propelling by the plunger, as shown in FIG. 2.

Although plunger 30 is shown to be slidingly supported on the holder, the plunger may alternatively, or additionally, be pivotally and/or rotatably connected to the holder. Additionally, although launch assembly 22 is shown to include the bias elements to move the plunger and propel the moveable objects, the launch assembly may alternatively, or additionally, include any suitable structure configured to selectively propel one or more of the moveable objects. For example, launch assembly 22 may include a plunger that is moved using one or more of a motor, a hydraulic cylinder, an air source, and a water source. Alternatively, the launch assembly may selectively propel the moveable objects without a plunger, such as directing air and/or water stream(s) toward one or more of the moveable objects and/or applying one or more bias elements directly to one or more of the moveable objects.

Track assembly 24 may include any suitable structure configured to support one or more of the moveable objects and/or to direct or guide the movable objects from any suitable location(s), such as from launch assembly 22, toward any suitable location(s), such as ramp assembly 26. For example, track assembly 24 may include at least one track 38 having a first track end portion 39 and a second track end portion 40, as shown in FIG. 1. The first track end portion may be adjacent or connected to the ramp assembly, while the second track end portion may be spaced from the ramp assembly, such as adjacent or connected to the launch assembly.

Additionally, track 38 may include one or more track sections 41, as shown in FIG. 1. The track sections may include suitable structure configured to allow selective attachment to each other, to the holder, to the ramp assembly, and/or to other suitable structures. For example, the track sections may include one or more tongue-and-groove structures (not shown) and/or other suitable structures.

Track sections 41 may include any suitable length(s) and/or any suitable shape(s). For example, one or more of the sections may be linear and/or planar, as shown in FIG. 1. Alternatively, or additionally, one or more of track sections 41 may be curved and/or sloped (upwards and/or downwards). In some embodiments, track 38 may include only planar track sections. In other embodiments, track 38 may include linear track sections and curved track sections. For example, track 38 may include spiraling track sections. In some embodiments, track 38 may include two or more paths for the moveable objects, where at least one of those paths may lead to the ramp assembly.

Although track 38 is shown to include linear track sections, the track may additionally, or alternatively, include curved and/or sloped track sections. Additionally, although track 38 is shown to be connected to the launch assembly and the ramp assembly, the track may alternatively be adjacent to or spaced from the launch assembly and/or the ramp assembly. For example, first track end portion 39 may terminate before a first ramp end portion of the ramp assembly such that at least one of the moveable objects may travel on a horizontal surface before reaching the first ramp end portion and/or may jump from the first track end portion to the first ramp end portion.

Figures 3A, 3B:
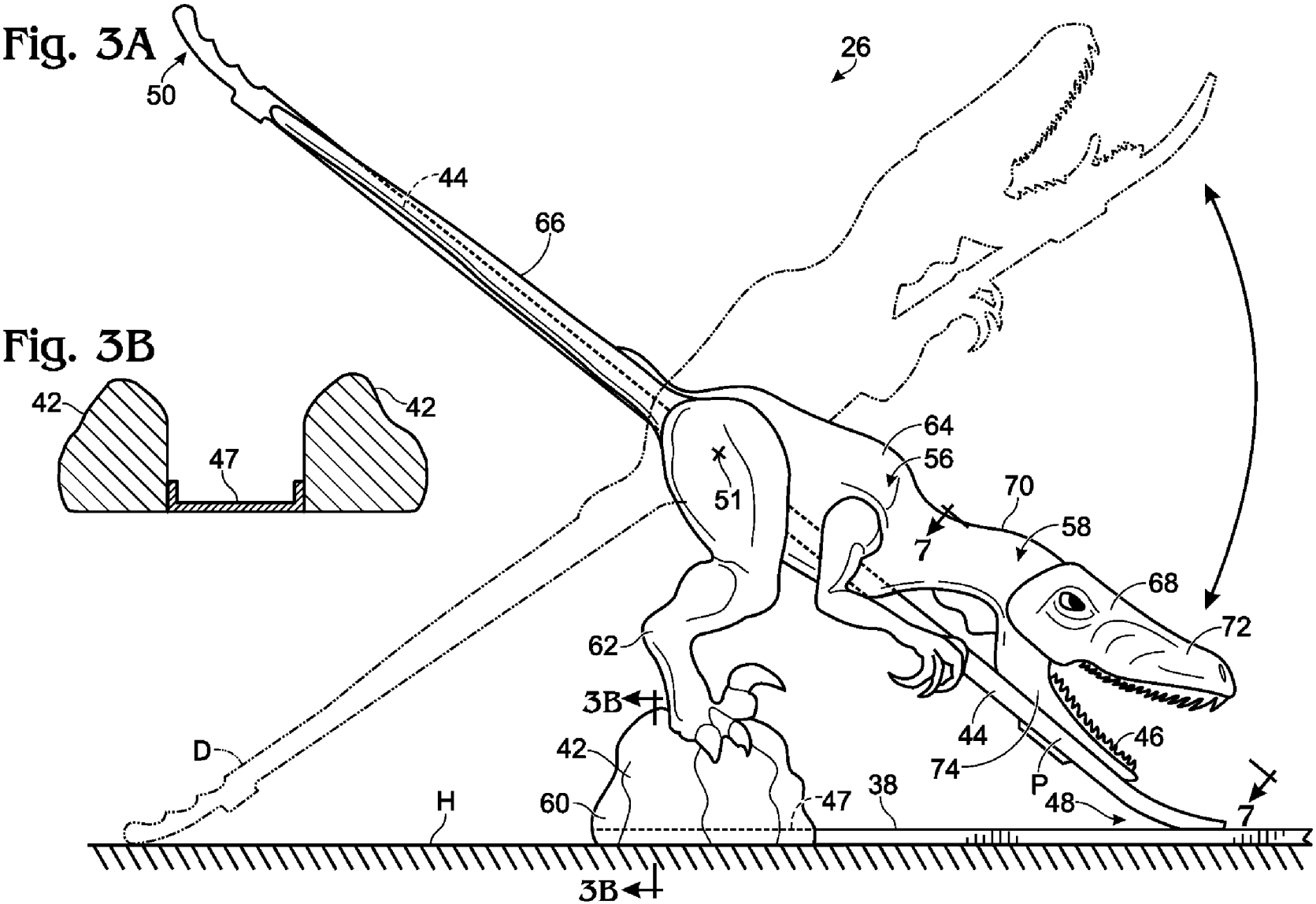
FIG. 3*a* is a partial side view of the toy ramp device of FIG. 1 showing an example of a ramp assembly.
FIG. 3*b* is a cross-sectional view of the ramp assembly of FIG. 3 taken along lines 3*b*-3*b* in FIG. 3 showing a base of the ramp assembly.

Ramp assembly 26 may include any suitable structure configured to support one or more of moveable objects 100 and/or interact with the launch assembly and/or the track assembly. For example, the ramp assembly may include a base 42, a ramp 44, and a holder mechanism 46, as shown in FIG. 3. The base may be configured to be supported on a horizontal surface H. Additionally, base 42 may include a base track 47, which may be configured to support one or more of the moveable objects and/or may be configured to be connected to the track of the track assembly, such as to first track end portion 39.

Ramp 44 may include a first ramp end portion 48 and a second ramp end portion 50. The ramp may be configured to support one or more of the moveable objects. Additionally, the ramp may be movably connected to the base and may be configured to move among a plurality of positions relative to the base. For example, as shown in FIG. 3, ramp 44 may move between a first or loading position P in which the first ramp end portion is aligned with or contacts a portion of a track (or contacts the horizontal surface when the track is not used), and a second or an unloading position D in which the first ramp end portion is spaced from the portion of the track (or the horizontal surface) relative to the first position.

In some embodiments, the second ramp end portion may contact the horizontal surface in the unloading position. Additionally, or alternatively, the ramp may be pivotally connected to the base and may pivot about a pivot axis 51 among the plurality of positions relative to the base. In some embodiments, the ramp may slope upwardly from the first ramp end portion toward the second ramp end portion when the ramp is in the loading position, and/or the ramp may slope downwardly from the first ramp end portion toward the second ramp end portion when the ramp is in the unloading position.

Although ramp 44 is shown to be pivotally connected to the base, the ramp may alternatively, or additionally, be slidingly and/or rotatably connected to the base. Additionally, although ramp 44 is shown to move between the loading and unloading positions, the ramp may additionally, or alternatively, move among any suitable positions. Moreover, although first ramp end portion 48 is shown to contact a portion of track 38 when the ramp is in the loading position and second ramp end portion 50 is shown to contact a horizontal surface when the ramp is in the unloading position, the first ramp end portion and/or the second ramp end portion may alternatively be spaced from the track and/or horizontal surface in those positions, respectively. For example, one or more of the moveable objects may have to jump onto the first ramp end portion to get on the ramp and/or jump off the second ramp end portion to get off the ramp.

Figure 4:
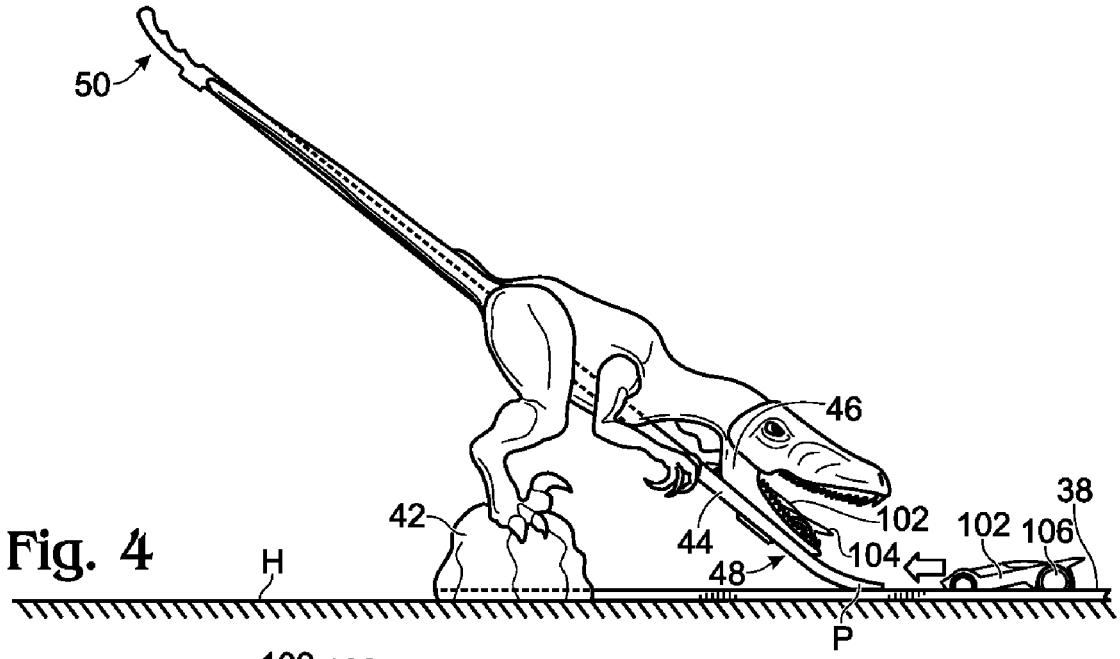
FIG. 4 is a partial side view of the toy ramp device of FIG. 1 showing a ramp of the ramp assembly of FIG. 3 in a loading position.
Figure 5:
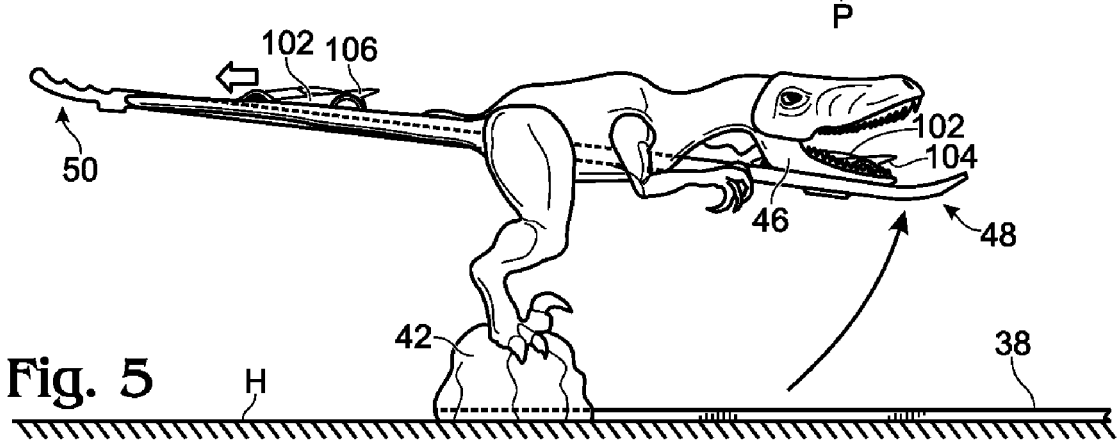
FIG. 5 is a partial side view of the toy ramp device of FIG. 1 showing the ramp of the ramp assembly of FIG. 3 in an intermediate position.
Figure 6:
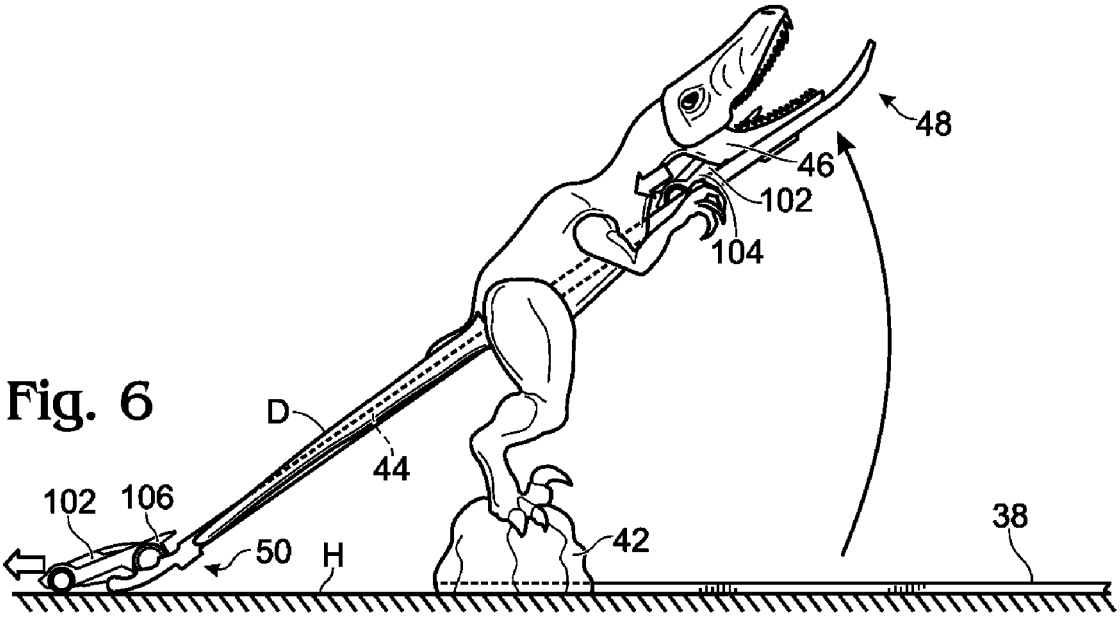
FIG. 6 is a partial side view of the toy ramp device of FIG. 1 showing the ramp of the ramp assembly of FIG. 3 in an unloading position.

Ramp 44 may additionally, or alternatively, be configured to move from the loading position toward the unloading position when at least one of the moveable objects moves from first ramp end portion 48 toward second ramp end portion 50, as shown in FIGS. 4-6. The ramp may be moved from the loading position toward the unloading position based, at least in part, on the weight of the moveable object(s) moving along the ramp. In some embodiments, the ramp may be configured to move from the unloading position toward the loading position when at least one of the moveable objects moves from the second ramp end portion toward the first ramp end portion.

Although one or more of the moveable objects are shown to be supported on the ramp, those objects may alternatively, or additionally, be supported in the ramp, from the ramp (such as hanging from the ramp), etc. Additionally, although the ramp is shown to be moved between positions by movement of one or more of the moveable objects along the ramp, the ramp may alternatively, or additionally, move between positions independent of that movement, such as via a motor.

Holder mechanism 46 may be configured to support and/or hold at least one of the moveable objects adjacent to the ramp and to selectively allow the at least one of the moveable objects to move onto and/or move along the ramp. For example, the holder mechanism may be configured to support the at least one of the moveable objects when the ramp is in the loading position, and allow the at least one of the moveable objects to move onto and/or move along the ramp (such as toward the second ramp end portion) when the ramp is in the unloading position.

The holder mechanism may include any suitable structure. For example, holder mechanism 46 may include a holder track 52 and at least one retainer 54, as shown in FIG. 7. The holder track may be connected to any suitable portion of ramp 44 (such as adjacent the first ramp end portion) and/or may be configured to support at least one of the moveable objects. Holder track 52 may be configured to allow one or more of the moveable objects to access the ramp, such as when the ramp is in the unloading position. Retainer 54 may include any suitable structure configured to secure or hold at least one of the moveable objects within the holder mechanism. For example, the retainer may include barrier in the form of a track end 56, which may prevent one or more moveable objects 100 from moving beyond the track end while allowing those objects to move onto the ramp.

Although retainer 54 is shown to include track end 56, the retainer may alternatively, or additionally, include any suitable structure such as one or more of a ramp, a stop, a bumper, etc. Additionally, although holder mechanism 46 is shown to include holder track 52 and retainer 54, the holder mechanism may include any suitable structure to support and/or hold at least one of the moveable objects adjacent to the ramp and to selectively allow the at least one of the moveable objects to move onto the ramp.

Toy ramp device 20 may include any suitable aesthetic feature(s) and/or components configured to increase play value of the device. For example, the toy ramp device may include one or more toy animals 56, where one or more parts of the toy animals may be incorporated with the different components of the toy ramp device, such as at least one of the base, the ramp, and the holder mechanism of the ramp assembly.

In some embodiments, ramp assembly 26 may be configured to resemble a toy dinosaur 58 on a toy rock 60, as shown in FIG. 3. For example, base 42 may include the rock and a lower portion 62 of the toy dinosaur and/or the ramp may include an upper portion 64 and a tail 66 of the toy dinosaur. Additionally, or alternatively, the holding mechanism may include a head 68 and/or a neck 70 of the toy dinosaur, where the head may include an upper jaw 72 and a lower jaw 74 and retainer 54 of the holding mechanism may hold the moveable object between the upper jaw and the lower jaw. One or more portions of the toy dinosaur may be movable to enhance play value of the toy ramp device. For example, the head of the toy dinosaur may be rotatable and/or the upper jaw may be movable relative to the lower jaw.

Although the ramp assembly is shown to be configured to resemble toy dinosaur 58 on toy rock 60, the ramp assembly and/or other portion(s) of the toy ramp device, may alternatively, or additionally, may be configured to resemble any suitable toy(s) and/or character(s). For example, the holding mechanism may resemble a toy cage, the base may resemble a toy mountain, and/or the ramp may resemble a path through the toy mountain.

Additionally, although ramp assembly 26 is shown to include base 42, ramp 44, and holder mechanism 46, the ramp assembly may additionally, or alternatively, include any suitable structure. For example, ramp assembly 26 may include one or more ramp bias elements (not shown) configured to urge the ramp toward the loading and/or unloading position (s). In some embodiments, the bias elements may urge the ramp toward the loading position so that the ramp is ready to support a second moveable object after a first moveable object gets off the second ramp end portion. Additionally, or alternatively, the bias elements may urge the ramp toward the unloading position such that the moveable object does not have to travel far from the first ramp end portion toward the second ramp end portion until the ramp begins to move from the loading position toward the unloading position. The bias elements may include one or more coil springs, leaf springs, weights, and/or other suitable structure.

Additionally, or alternatively, the ramp assembly may include audio and/or visual mechanisms configured to produce light and/or sound effects. Those light and/or sound effects may be synchronized with one or more movements of the ramp and/or other component(s) of the toy ramp device. For example, a first dinosaur sound effect may be generated when the ramp is in the loading position, while a second dinosaur sound effect may be generated when the ramp is in the unloading position. Additionally, or alternatively, lamps may be provided in one or more portions of the toy dinosaur, such as for the eyes, to provide light effects. Although toy ramp device 20 is shown to include launch assembly 22, track assembly 24, and ramp assembly 26, the toy ramp device may additionally, or alternatively, include any suitable structure configured to support one or more of the moveable objects.

In operation, ramp 44 may be moved to the loading position such that the first ramp end portion contacts a portion of the track, as shown in solid lines in FIG. 3. Additionally, a first toy vehicle 122 may be positioned in holder mechanism 46, as shown in FIG. 4. A second toy vehicle 124 may be propelled from launch assembly 22 with sufficient force to move along the track toward the portion of the track contacted by the first ramp end portion and onto the first ramp end portion, as shown in FIG. 4. As the second toy vehicle moves from the first ramp end portion past the pivot toward the second ramp end portion, the ramp may move from the loading position toward the unloading position, as shown in FIG. 5.

When the second toy vehicle reaches or is adjacent the second ramp end portion, the ramp may move to the unloading position such that the second ramp end portion may contact a horizontal surface, which may allow the second toy vehicle to move away from the ramp. With the ramp inclined downwardly toward the second ramp end portion, such as when the ramp approaches or is in the unloading position, the first toy vehicle may move under the force of gravity from the holder track onto the ramp and toward the second ramp end portion. The first toy vehicle may then move off the second ramp end portion and onto the horizontal surface, after which the ramp may move back to the loading position. A third toy vehicle 108 may be propelled along the track while the ramp is not in the loading position (or is returning to the loading position via urging of one or more bias elements) and may move along track 34 and base track 47 and onto a horizontal surface, as shown in FIGS. 8-9.

Although a particular operation of the toy ramp device is discussed, many variations to the operation may be made. For example, the toy ramp device may be operated without track assembly 24. A user may propel the moveable objects from launch assembly 22 spaced from the ramp assembly while trying to position the launch assembly such that the movable objects move onto the first ramp end portion. Additionally, or alternatively, the toy ramp device may be operated without launch assembly 22, where a user may propel the moveable objects by hand and/or other means.

Although the present invention has been shown and described with reference to the foregoing operational principles and preferred embodiments, it will be apparent to those skilled in the art that various changes in form and detail may be made without departing from the spirit and scope of the invention. For example, variations in the details of the toy ramp device appearance, the moveable objects, and operation of the toy ramp device may be envisioned. The present invention is intended to embrace all such alternatives, modifications and variances that fall within the scope of the appended claims.

What is claimed is:

1. A toy ramp device for two or more moveable objects, comprising:

a base configured to be supported on a horizontal surface;

a ramp configured to support at least a first of the two or more moveable objects and including a first ramp end portion and a second ramp end portion, the ramp being movably connected to the base and configured to move among a plurality of positions relative to the base, including a first position in which the first ramp end portion contacts the horizontal surface, and a second position in which the first ramp end portion is spaced from the horizontal surface; and a holder mechanism including a first holder end portion and a second holder end portion, the first holder end portion being attached to the ramp and the second holder end portion being spaced from the ramp, the second holder end portion being configured to support at least a second of the two or more moveable objects adjacent to but spaced from the ramp when the ramp is in the first position, and the first holder end portion being configured to allow the at least a second of the two or more moveable objects to move from the second holder end portion onto the ramp and move along the ramp toward the second ramp end portion when the ramp is in the second position.

2. The toy ramp device of claim 1, wherein the ramp is further configured to move from the first position toward the second position when the at least a first of the two or more moveable objects moves along the ramp from the first ramp end portion toward the second ramp end portion.

3. The toy ramp device of claim 1, further comprising a track configured to support the at least a first of the two or more moveable objects, wherein the first ramp end portion contacts a portion of the track in the first position, and the first ramp end portion is spaced from the portion of the track in the second position.

4. The toy ramp device of claim 3, wherein the track includes a first track end portion connected to the base and a second track end portion spaced from the base.

5. The toy ramp device of claim 4, further comprising a launch assembly configured to selectively propel the at least a first of the two or more moveable objects along the track toward the portion of the track contacted by the first ramp end portion.

6. The toy ramp device of claim 5, wherein the launch assembly is connected to the second track end portion.

7. The toy ramp device of claim 1, further comprising a launch assembly configured to selectively propel the at least a first of the two or more moveable objects onto the first ramp end portion when the first ramp end portion is in the first position.

8. A toy ramp device for two or more moveable objects, comprising:

configured to be supported on a horizontal surface;

a base configured to be supported on a horizontal surface;

a track attached to the base and configured to support at least a first of the two or more moveable objects;

a ramp configured to support the at least a first of the two or more moveable objects and including a first ramp end portion and a second ramp end portion, the ramp being movably connected to the base and configured to move among a plurality of positions, including a first position in which the first ramp end portion is aligned with a portion of the track, and a second position in which the first ramp end portion is spaced from the portion of the track relative to the first position, wherein the ramp is configured to move from the first position toward the second position when the at least a first of the two or more moveable objects moves along the ramp from the first ramp end portion toward the second ramp end portion; and a holder mechanism including a first holder end portion and a second holder end portion, the first holder end portion being attached to the ramp and the second holder end portion being spaced from the ramp and from the horizontal surface when the ramp is in the first position, the second holder end portion being configured to support at least a second of the two or more moveable objects adjacent to but spaced from the ramp when the ramp is in the first position, and the first holder end portion being configured to allow the at least a second of the two or more moveable objects to move from the second holder end portion onto the ramp and move along the ramp toward the second ramp end portion when the ramp is in the second position.

9. The toy ramp device of claim 8, wherein the first ramp end portion contacts the portion of the track when the ramp is in the first position.

10. The toy ramp device of claim 8, wherein the track includes a first track end portion attached to the base and a second track end portion spaced from the base.

11. The toy ramp device of claim 8, wherein the track includes one or more planar track sections.

12. The toy ramp device of claim 8, wherein the ramp is pivotally connected to the base and configured to pivot among the plurality of positions relative to the base.

13. The toy ramp device of claim 8, wherein the ramp slopes upwardly from the first ramp end portion toward the second ramp end portion when the ramp is in the first position.

14. The toy ramp device of claim 13, wherein the ramp slopes downwardly from the first ramp end portion toward the second ramp end portion when the ramp is in the second position.

15. The toy ramp device of claim 8, wherein the holder mechanism includes a holder track connected to a portion of the ramp and configured to support the at least one of the two or more moveable objects.

16. The toy ramp device of claim 15, wherein the portion of the ramp is adjacent the first ramp end portion.

17. A toy ramp device, comprising:

two or more toy vehicles;

a base configured to be supported on a horizontal surface;

a track including a first track end portion attached to the base and a second track end portion spaced from the base;

a launch assembly attached to the second track end portion and configured to selectively propel at least a first of the two or more toy vehicles toward the first track end portion;

a ramp configured to support the at least a first of the two or more toy vehicles and including a first ramp end portion and a second ramp end portion, the ramp being pivotally connected to the base and configured to pivot among a plurality of positions, including a first position in which the ramp slopes upwardly from the first ramp end portion toward the second ramp end portion, and a second position in which the ramp slopes downwardly from the first ramp end portion toward the second ramp end portion, wherein the ramp is configured to move from the first position toward the second position when the at least a first of the two or more toy vehicles moves along the ramp from the first ramp end portion toward the second ramp end portion; and a holder mechanism including a first holder end portion and a second holder end portion, the first holder end portion being connected to the ramp and the second holder end portion being spaced from the ramp and from the horizontal surface when the ramp is in the first position, the second holder end portion being configured to support at least a second of the two or more toy vehicles adjacent to but spaced from the ramp when the ramp is in the first position, and the first holder end portion being configured to allow the at least a second of the two or more toy vehicles to move from the second holder end portion onto the ramp and move along the ramp toward the second ramp end portion when the ramp is in the second position.

18. The toy ramp device of claim 17, wherein at least one of the base, the ramp, and the holder mechanism includes at least a portion of a toy animal.

19. The toy ramp device of claim 18, wherein the holder mechanism includes a head of the toy animal and the head includes an upper jaw and a lower jaw, and the head is configured to support the at least one of the two or more toy vehicles between the upper jaw and the lower jaw when the ramp is in the first position.

20. The toy ramp device of claim 18, wherein the ramp includes a tail of the toy animal.

21. The toy ramp device of claim 1, wherein the second holder end portion is spaced from the horizontal surface when the ramp is in the first position.

* * * * *